US006318333B1

(12) United States Patent
Narita et al.

(10) Patent No.: US 6,318,333 B1
(45) Date of Patent: Nov. 20, 2001

(54) ACCESSORY ARRANGEMENT STRUCTURE FOR INTERNAL COMBUSTION ENGINE

(75) Inventors: Satoru Narita; Takashi Shichinohe; Hidenori Yasuda, all of Saitama (JP)

(73) Assignee: Honda Giken Kogyo Kabushiki Kaisha

( * ) Notice: Subject to any disclaimer, the term of this patent is extended or adjusted under 35 U.S.C. 154(b) by 0 days.

(21) Appl. No.: 09/654,564

(22) Filed: Sep. 1, 2000

(30) Foreign Application Priority Data

Sep. 3, 1999 (JP) ..... 11-250812

(51) Int. Cl.[7] ..... F01M 1/02
(52) U.S. Cl. ..... 123/196 R
(58) Field of Search ..... 123/196 R, 192.2

(56) References Cited

U.S. PATENT DOCUMENTS 5,461,940 * 10/1995 Morita ..... 123/192.2
5,887,564 * 3/1999 Kawamoto ..... 123/196 R
5,899,186 * 5/1999 Kawamoto ..... 123/196 R
6,205,971 * 3/2001 Inumaru et al. ..... 123/196 R
6,230,680 * 5/2000 Pirone ..... 123/196 R

* cited by examiner

*Primary Examiner*—Marguerite McMahon
(74) *Attorney, Agent, or Firm*—Birch, Stewart, Kolasch & Birch, LLP

(57) ABSTRACT

A power unit, including an engine and a transmission, is transversely arranged in a vehicle with a crankshaft arranged parallel to a traveling direction of the vehicle. Looking at a crankcase from the front, a camshaft is arranged to one side of the crankshaft. A balancer shaft is also located on the one side of the crankshaft and coaxailly drives an oil pump. The transmission and an oil tank are arranged on the opposite side of the crankshaft. The crankshaft includes a crank sprocket which drives the cam shaft via a cam chain and a cam sprocket provided on one end of the cam shaft. The cam sprocket and the oil pump are arranged on either side of a balancer attached to the balancer shaft. The power unit arrangement allows for an increase in the potential capacity of the oil pump of a dry sump type lubrication system without causing an increase in the size of a crankcase.

14 Claims, 10 Drawing Sheets

ACCESSORY ARRANGEMENT STRUCTURE FOR INTERNAL COMBUSTION ENGINE

BACKGROUND OF THE INVENTION

1. Field of the Invention

The present invention relates to an arrangement for various components of an internal combustion engine.

2. Description of the Relevant Art

An engine, such as a transverse engine provided with a crankshaft facing in the direction of travel of the vehicle, is shown in the background art of Japanese Patent Laid-open No. Hei. 7-195949. In the engine of the background art, a camshaft, a balancer shaft and an oil pump are arranged vertically elevated one from the other on one side of the crankshaft. A transmission is arranged on the other side of the crankshaft. The arrangement of the engine components, looking from the front, is such that a balancer and the camshaft are arranged on an outer side of the crankshaft. An oil pump is arranged close to one of either the balancer or the camshaft. Further, the oil pump is arranged on the same side of the crankshaft as a chain for driving the camshaft.

In the background art, the camshaft and the suplementary parts for operation of a valve mechanism and parts of the lubrication system are arranged on one side of the crankshaft, near a chain for driving the camshaft and the oil pump. In order to adopt a dry sump structure with this arrangement, it is necessary to plumb an oil pipe to the periphery of the oil pump. Further, it is necessary to increase the size of the case.

In the case where a dry sump structure is adopted while suppressing the overall height of the engine, it is necessary to provide a large internal oil tank arrangement space, which means it becomes necessary to provide a separate oil tank. If this is done then the oil tank, and oil cooler and the engine must be joined together using a plurality of expensive and heavy hoses, thus increasing the number of parts, the costs and the weight.

SUMMARY OF THE INVENTION

It is an object of the present invention to address one or more of the drawbacks associated with the background art.

These and other objects are accomplished by an internal combustion engine comprising: a crankcase; an oil tank inside said crankcase, an oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; a crankshaft disposed in said crankcase; and a camshaft having a driven section attached thereto to be driven to rotate by rotation of said crankshaft, wherein said camshaft and said oil pump are arranged on one of a left side or a right side of said crankshaft and a transmission is arranged on the other of said left side or said right side of said crankshaft.

Further, these and other objects are accomplished by an internal combustion engine comprising: a crankcase; an oil tank inside said crankcase; an oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; a crankshaft disposed in said crankcase; a camshaft having a driven section attached thereto to be driven to rotate by rotation of said crankshaft; and a balancer shaft having a balancer thereon, with said balancer shaft being parallel to said camshaft, wherein said driven section of said camshaft and said oil pump are respectively arranged on opposite sides of said balancer of said balancer shaft.

Moreover, these and other objects are accomplished by a combination comprising: a vehicle; and an internal combustion engine including: a crankcase; an oil tank inside said crankcase; an oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank; a crankshaft disposed in said crankcase; a camshaft having a driven section attached thereto to be driven to rotate by rotation of said crankshaft; and a balancer shaft having a balancer thereon, with said balancer shaft being parallel to said camshaft, wherein said camshaft, said balancer shaft, and said oil pump are arranged on one of a left side or a right side of said crankshaft and a transmission is arranged on the other of said left side or said right side of said crankshaft, and wherein said driven section of said camshaft and said oil pump are respectively arranged on opposite sides of said balancer of said balancer shaft.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 2:
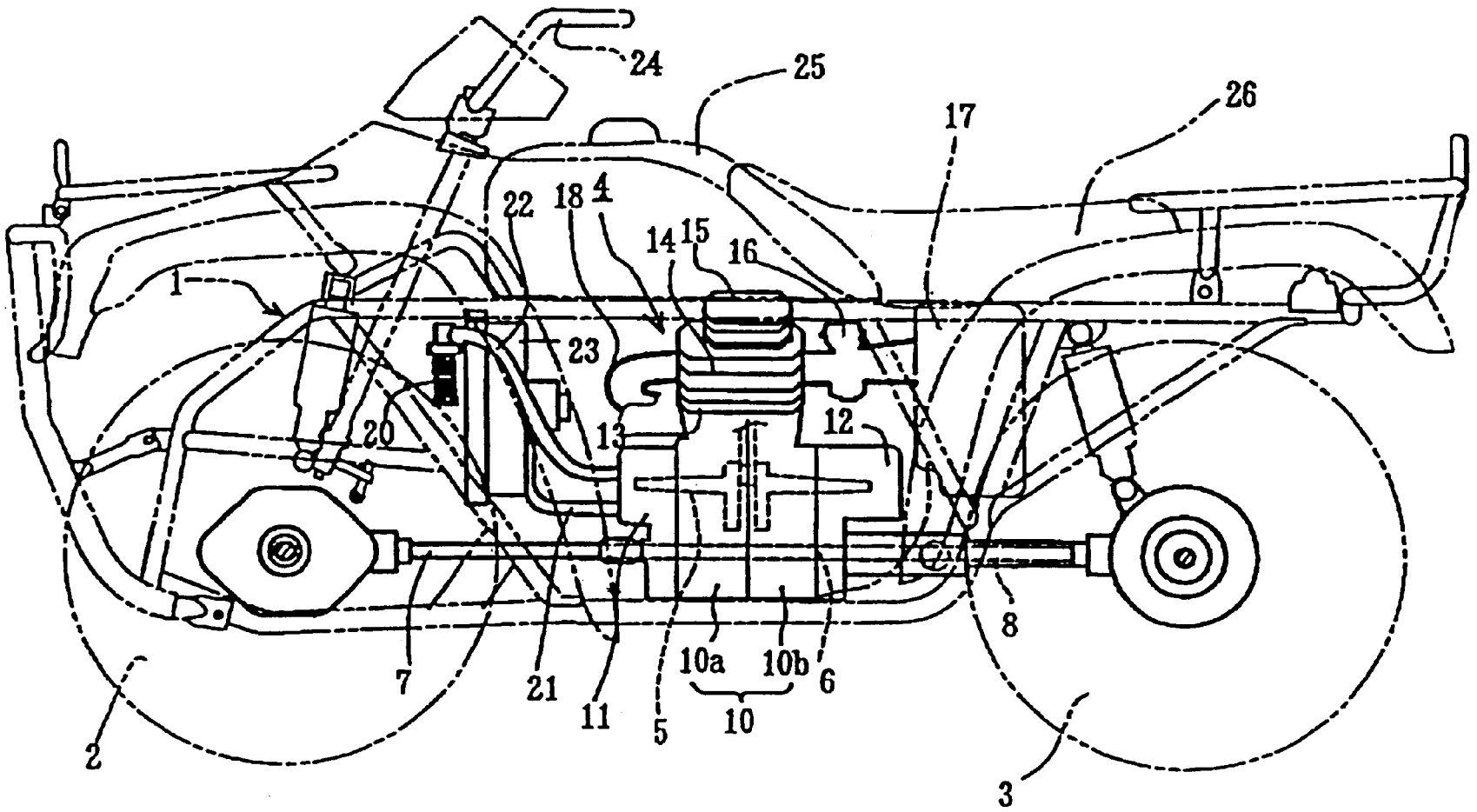
FIG. 2 is a side view of an ATV including a power unit, in accordance with the present invention.

A description will now be given of an embodiment of the present invention applied to a four-wheeled buggy or allterrain vehicle (ATV). As illustrated in FIG. 2, the four-wheeled buggy is provided with a pair of left and right front wheels 2 and a pair of left and right rear wheels 3, taken in a longitudinal direction of the vehicle frame 1. A power unit 4, comprising an engine and a transmission 44, is supported in a central portion of the vehicle frame 1. The power unit 4 has a transverse structure, wherein a crankshaft 5 extends in the longitudinal direction of the vehicle.

The four-wheeled buggy is a four-wheel drive type. An output shaft 6 is provided parallel to the crankshaft 5 and below the power unit 4. The front wheels 2 are driven via a front wheel propeller shaft 7 connected to the output shaft 6. The rear wheels 3 are driven via a rear wheel propeller shaft 8 connected to the output shaft 6.

A front side of a crankcase 10, constituting the power unit 4, is covered by a front case cover 11. A rear side is covered by a rear case cover 12. These case covers 11, 12 house the power unit 4.

The crankcase 10 is also longitudinally partitioned into a front case 10*a* and a rear case 10*b*. A cylinder block 13, a cylinder head 14 and a cylinder head cover 15 are attached to an upper part of the crankcase 10. A carburetor 16 is connected to an intake port of the cylinder head 14. An air cleaner 17 is connected to a rear side of the carburetor 16. An exhaust pipe 18 is connected to an exhaust port of the cylinder head 14.

An oil cooler 20 is arranged in front of the power unit 4 with a cooling surface facing toward the traveling direction of the ATV. The oil cooler 20 receives oil from the crankcase 10 via a feed side hose 21, and returns oil to the crankcase via a return side hose 22. An oil pump 62, in the crankcase 10, facilitates the circulation of oil. The ATV also includes a cooling fan 23, a handlebar 24, a fuel tank 25, and a saddle type seat 26.

Figure 3:
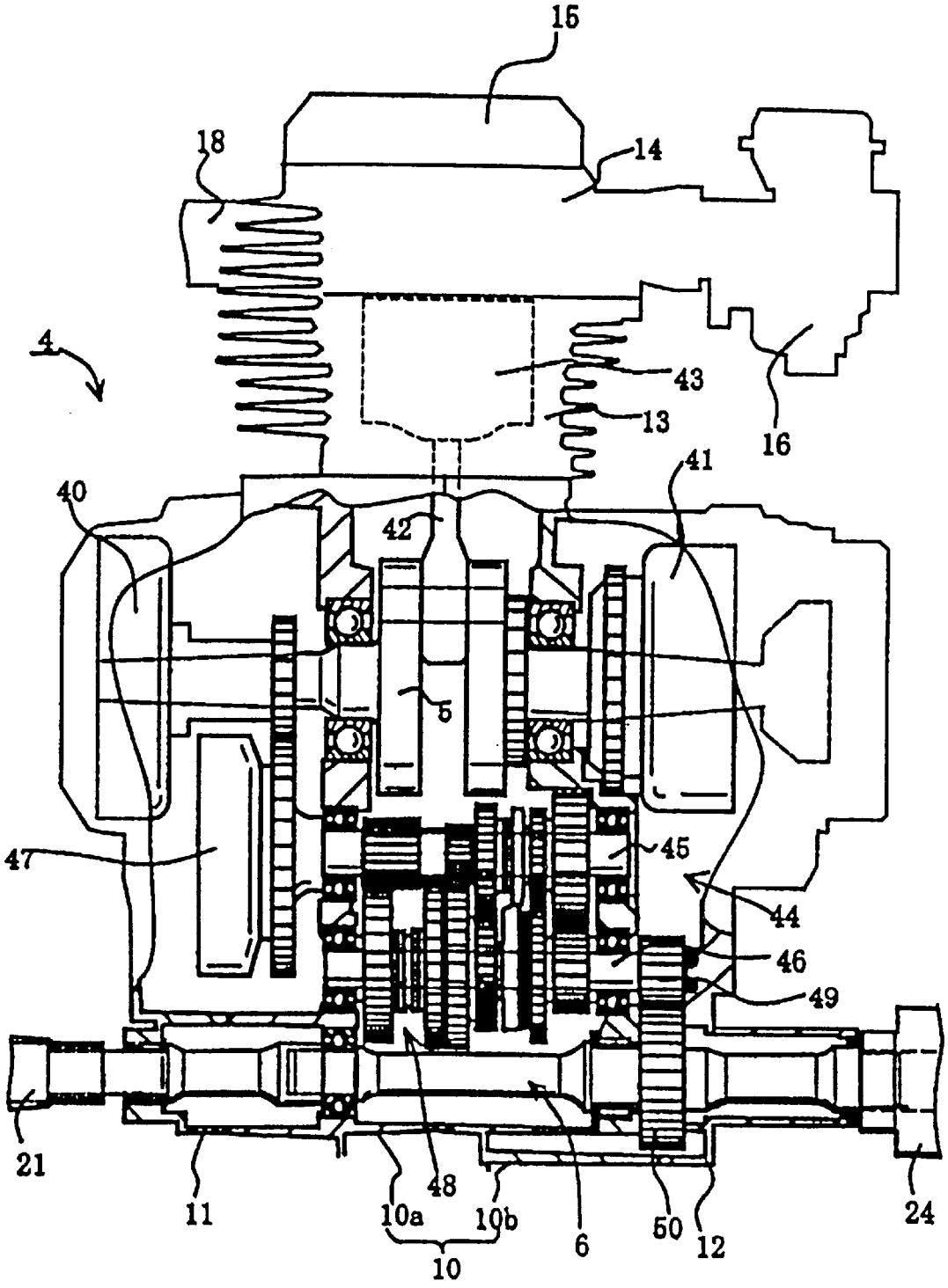
FIG. 3 is a partial cross sectional view of the power unit of FIG. 2.

FIG. 3 is a cross sectional view of a transmission mechanism portion of the power unit 4. As set forth above, the front side of the crankcase 10 is covered by a front case cover 11, while the rear side is covered by the rear case cover 12. The crankcase 10, and the front and rear covers 11, 12 constitute the power unit case. Also, the cylinder block 13, the cylinder head 14 and the cylinder head cover 15 are attached to an upper part of the crankcase 10.

The crankcase 10 is made up of two longitudinally divided sections, namely the front case 10*a* and the rear case 10*b*. The crankshaft 5 is fitted between the front case 10*a* and the rear case 10*b*. A starting clutch 40, such as a well-known centrifugal clutch mechanism, is provided on one end of the crankshaft 5. An AC generator (ACG) 41 is provided on the other end of the crankshaft 5. The cross sectional view of FIG. 3 also illustrates a connecting rod 42 and a piston 43.

The transmission 44 may be constructed as a well-known constant-mesh transmission. The transmission 44 includes a main shaft 45 and a counter shaft 46 arranged parallel to the crankshaft 5. A speed change clutch, or centrifugal clutch, 47 is provided on one end of the main shaft 45. The speed change clutch 47 selectively couples and disconnects a drive force of the crankshaft 5 to the main shaft 45. A plurality of constant mesh transmission gear trains 48 are provided between the main shaft 45 and the counter shaft 46. The gear trains 48 are used to selectively change a rotation speed at which the counter shaft 46 is driven by the main shaft 45. Rotation of the counter shaft 46 is output from a final drive gear 49, provided on one end of the counter shaft 46, to a final driven gear 50 on the output shaft 6.

Figure 1:
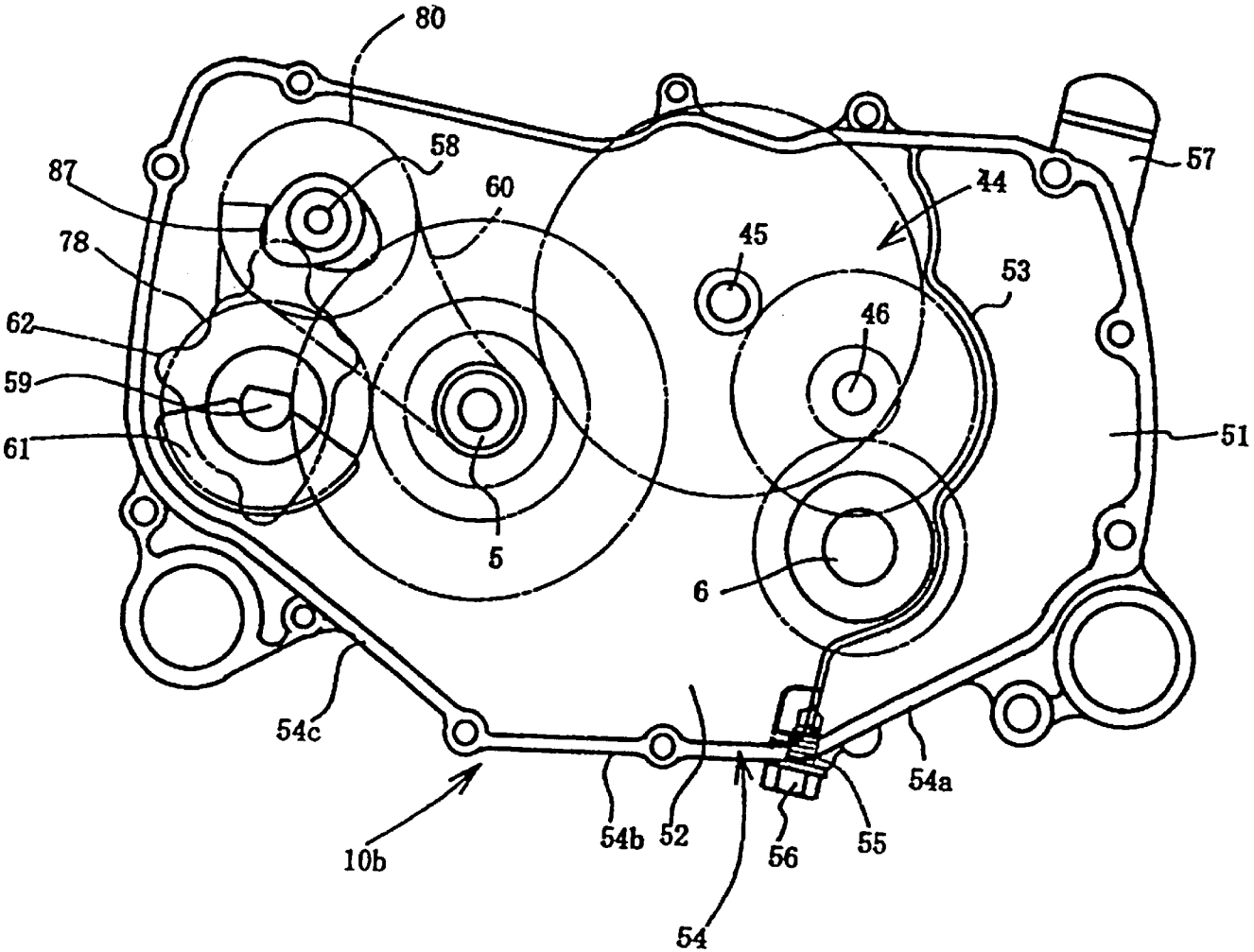
FIG. 1 is a front view illustrating an arrangement of respective shafts in a crankcase, in accordance with the present invention.

FIG. 1 is a schematic diagram illustrating the layout of each shaft in the rear case 10*b*. FIG. 1 depicts the parting plane of the rear case 10*b* and the front case 10*a*, seen from a front side of the vehicle. The transmission 44 is arranged on the right side of the crankshaft 5. An oil tank 51 is provided on an end of the transmission 44, to the right of the transmission 44. The oil tank 51 is formed between the front case cover 11 and the front case 10*a*, and between the front case 10*a* and the rear case 10*b*. The oil tank 51 is partitioned from a transmission chamber 52, housing the transmission 44, by a partitioning wall or bulkhead 53.

The bulkhead 53 starts from an upper end of the rear case 10*b*, extends along the right side of the transmission 44, and reaches to a bottom portion 54 of the rear case 10*b*. A lower end of the bulkhead 53 extends below the output shaft 6. The oil tank 51 is longer in the vertical direction, and as a result, the oil tank 51 is formed into a substantially crescent shape, when viewed from the front (as illustrated in FIG. 1).

Each of the front case 10*a* and the rear case 10*b* of the crankcase 10 has the same contour or outline shape, in the plane of FIG. 1 . The bottom section 54 slopes towards the center, via a left sloping surface 54*c* on the left side and a right sloping surface 54*a* on the right side, becoming narrower towards the center, with a central portion being the lowest point. A lower end of the bulkhead 53 is connected to a connection point between the right sloping section 54*a* and a central section 54*b*, forming the bottom of the oil tank 51. The connection point of the three wall sections is punched out towards the bulkhead 53, so that a drain hole 55 communicates with both the oil tank 51 and the transmission chamber 52. A drain bolt 56 is fitted into this drain hole 55. An oil inlet 57 is provided in an upper part of the oil tank 51.

A cam shaft 58 and a balancer shaft 59 are arranged parallel with each other. The cam shaft 58 and the balancer shaft 59 are located on the left side of the crankshaft 5. In other words, the cam shaft 58 and the balancer shaft 59 are located on a side opposite to the transmission 44 relative to the crankshaft 5. The camshaft 58 is driven by the crankshaft 5, via a cam chain 60. The balancer shaft 59 is also driven by the crankshaft 5, so that a balancer 61, on the balancer shaft 59, rotates in synchronism with the crankshaft 5. The balancer shaft 59 is linked to the oil pump 62 at its front end, and drives the oil pump 62.

Figure 4:
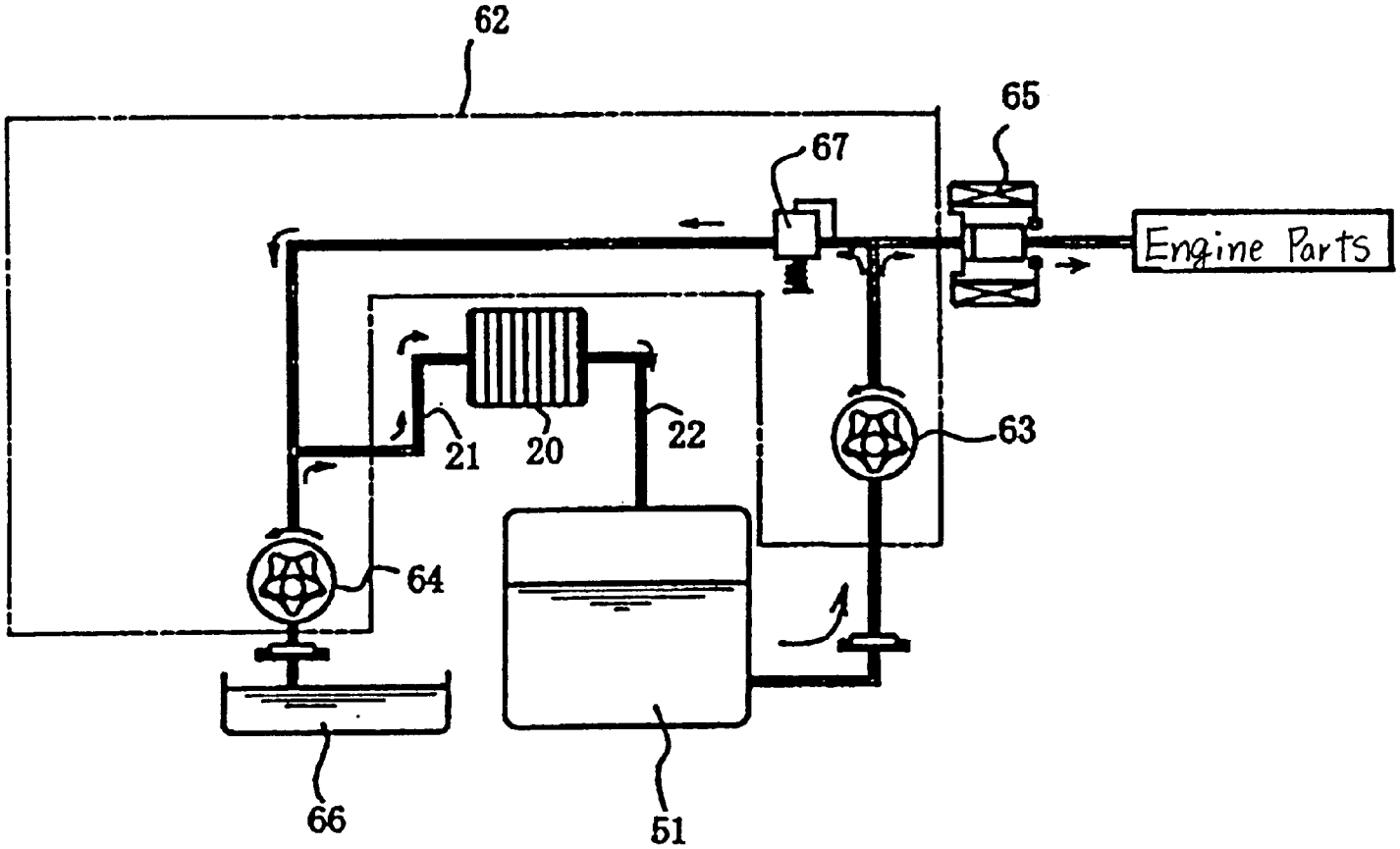
FIG. 4 is a diagram illustrating a flow of oil through a lubrication system, in accordance with the present invention.

Referring to FIG. 4, the oil pump 62 includes a feed pump 63 and a scavenge pump 64. The feed pump 63 and the scavenge pump 64 have respective rotors on the same drive shaft, and are preferably integrally formed. The feed pump 63 sucks oil from the oil tank 51 and supplies the oil, through an oil filter 65, to respective lubrication sections of the engine. The scavenge pump 64 draws oil from an oil sump 66, which is formed, for instance, at the central section 54*b* of the bottom section 54, sends the oil to the oil cooler 20. After the oil passes through the oil cooler 20, the oil is returned to the oil tank 51. A relief valve 67 is provided inside the discharge passageway of the feed pump 63. If the discharge pressure of the feed pump 63 exceeds a specified pressure, an escape is opened to the discharge passageway of the scavenge pump 64.

Figure 5:
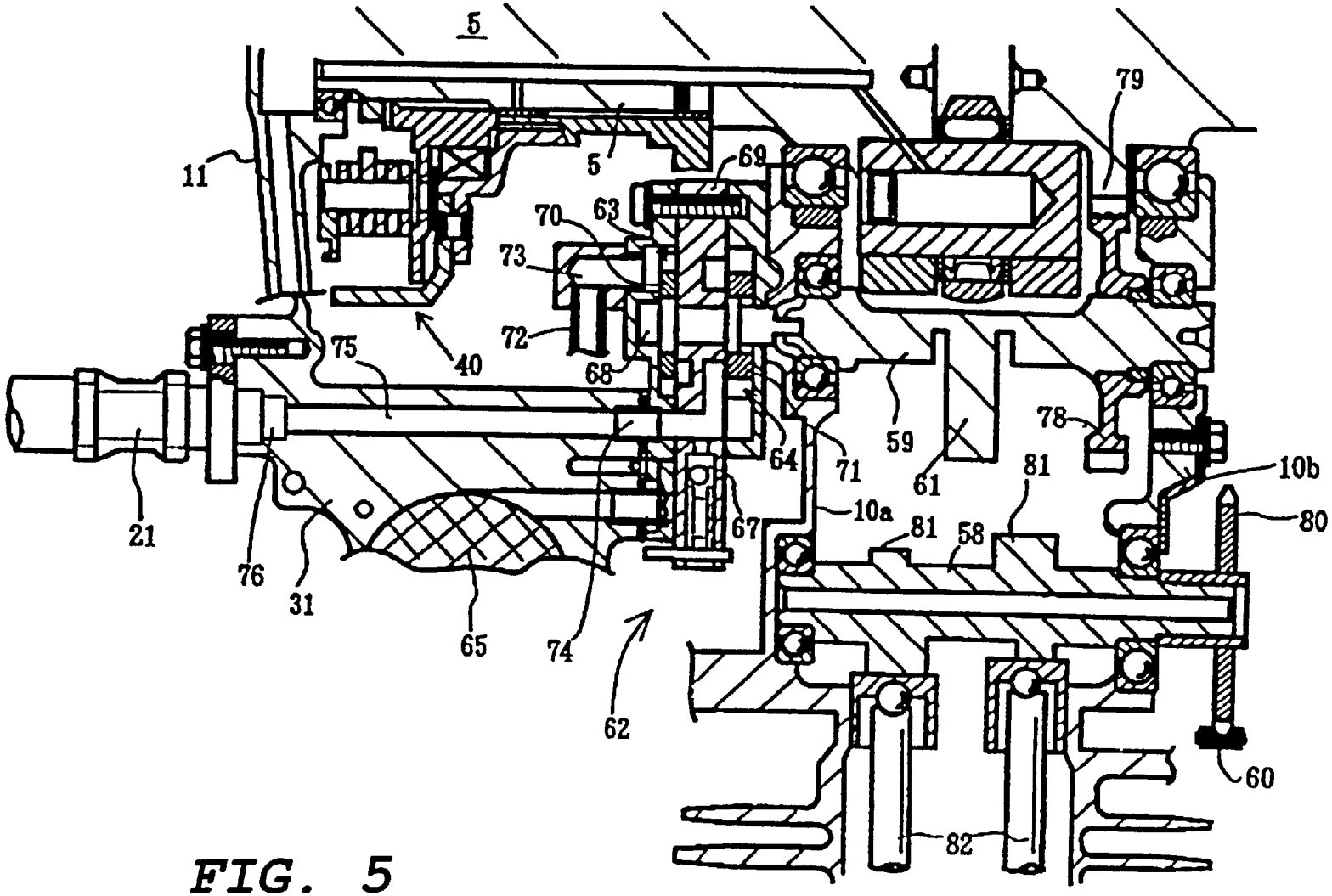
FIG. 5 is a cross sectional view illustrating an oil pump of the lubricating system.

FIG. 5 is a cross section drawing illustrating the oil pump 62. The feed pump 63 and the scavenge pump 64 are integrally formed with each other inside a common pump housing. A feed pump rotor 70 for the feed pump 63 and a scavenge pump rotor 71 for the scavenge pump 64 are arranged on a common drive shaft 68, while being disposed on opposite sides of a dividing or partition wall 69. The drive shaft 68 is arranged coaxially with the balancer shaft 69. The drive shaft 68 is arranged to the front of the front case 10*a*, while the balancer shaft 59 is arranged between the front case 10*a* and the rear case 10*b*. The drive shaft 68 and the balancer shaft 59 are connected and rotate integrally.

In FIG. 5, a feed pump pipe 72 for the feed pump 63 is connected to an inlet 73 of the feed pump 63. A scavenge pump discharge port 74 of the scavenge pump 64 leads to a discharge passageway 75 formed in the front case cover 11. One end of the feed side hose 21 is connected to an outlet 76 of the discharge passageway 75.

A balancer gear 78 is provided on the balancer shaft 59. The balancer gear 78 meshes with a balancer drive gear 79 formed on the crankshaft 5. A cam sprocket 80 is provided at one end of the cam shaft 58. The cam sprocket 80 is driven by a drive sprocket provided on the crankshaft 5, via the cam chain 60. A cam 81 on the cam shaft 58 drives a valve mechanism on the cylinder head 14 side, via a push rod 82.

Figure 6:
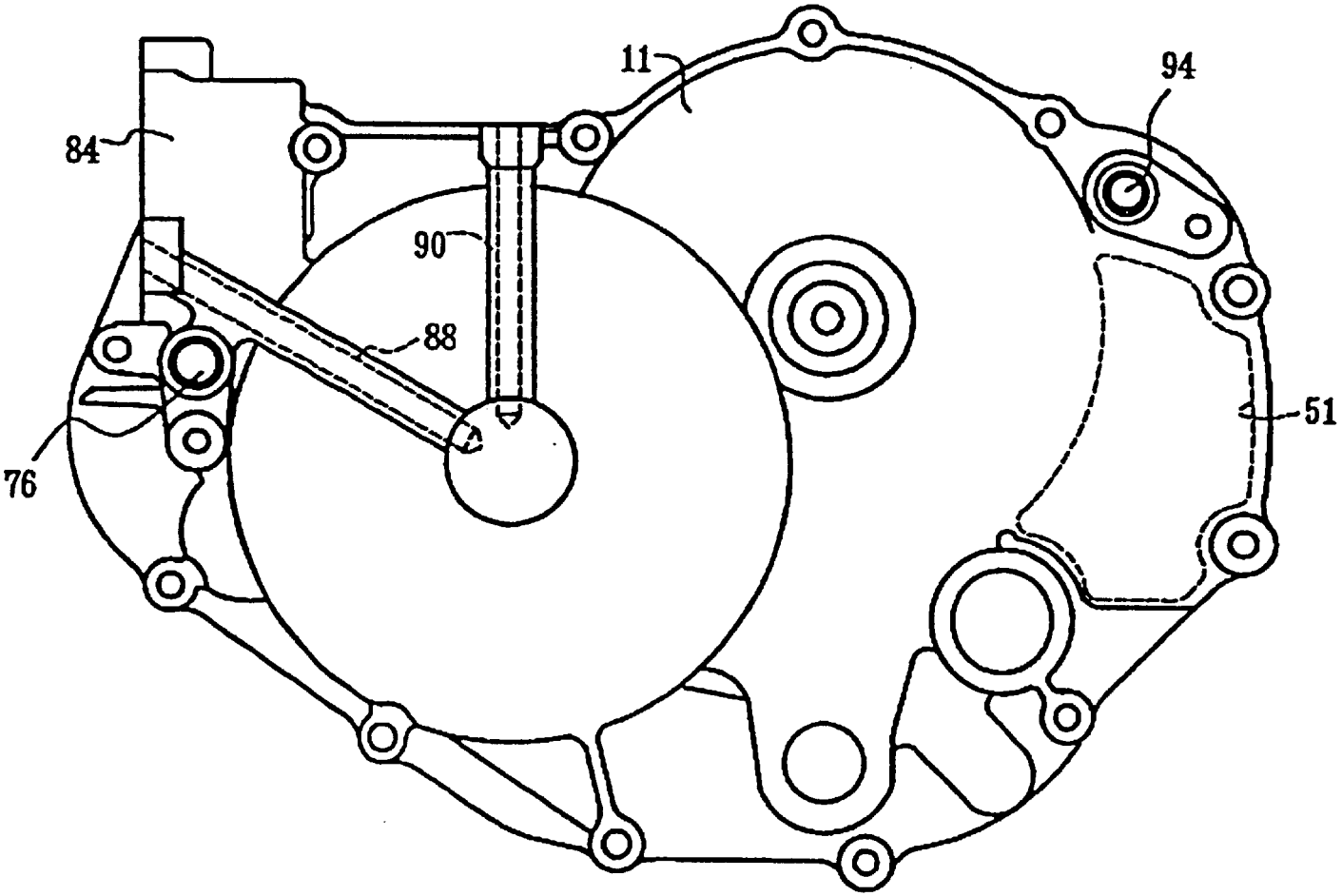
FIG. 6 is a front view illustrating a front case cover.
Figure 7:
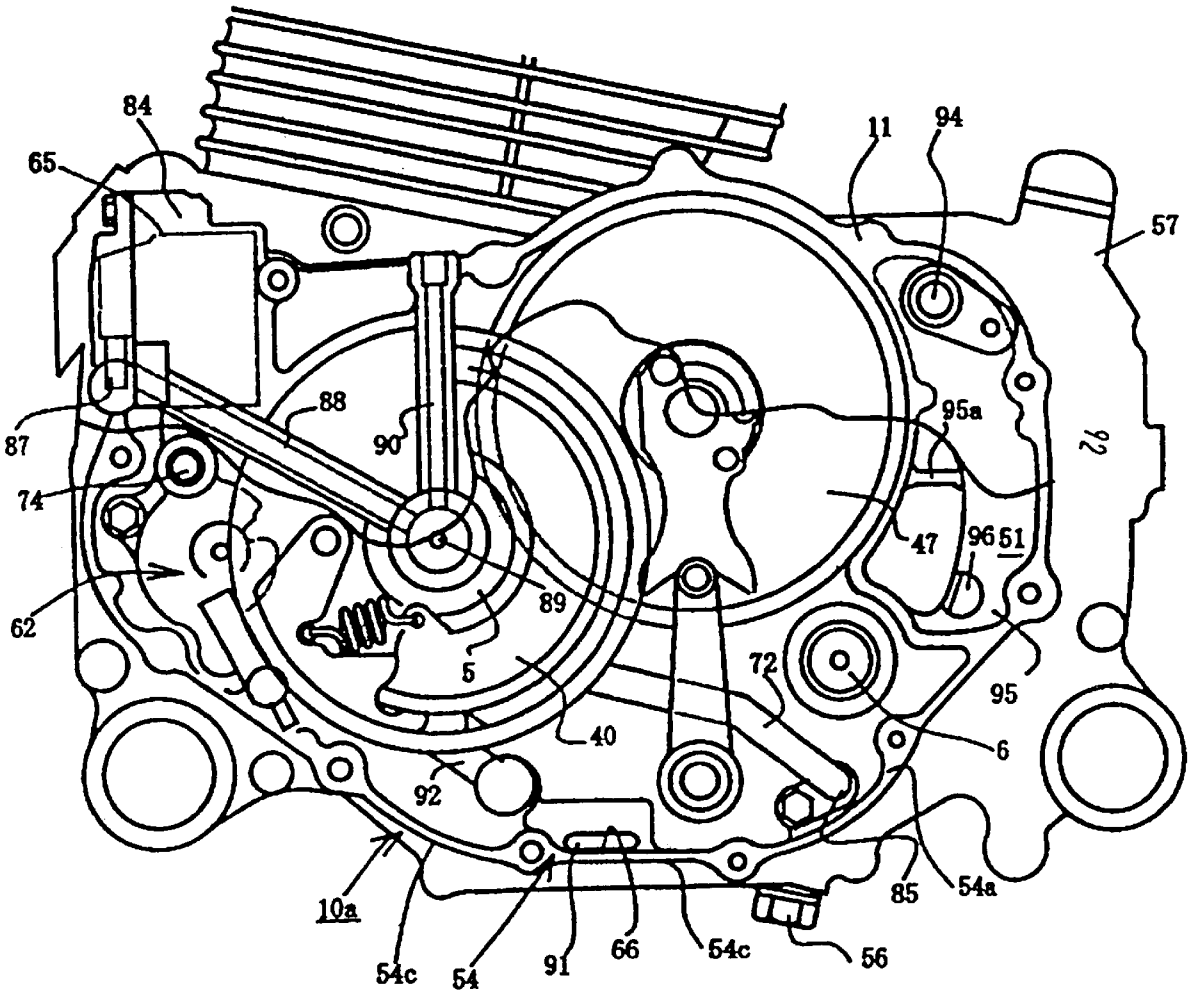
FIG. 7 is a front view of a front case of a crankcase.
Figure 8:
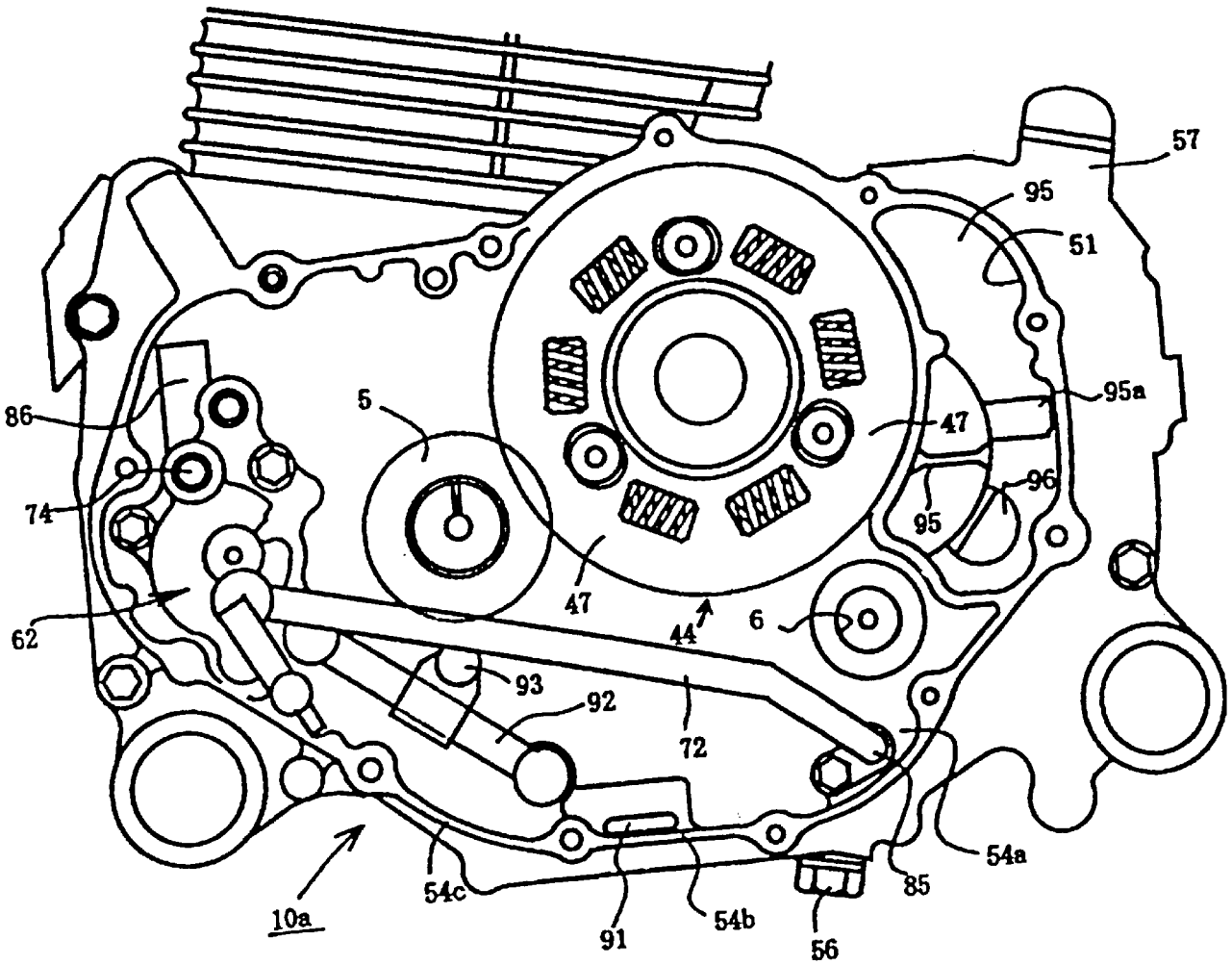
FIG. 8 is a front view of the front case of the crankcase, with a starting clutch removed.
Figure 9:
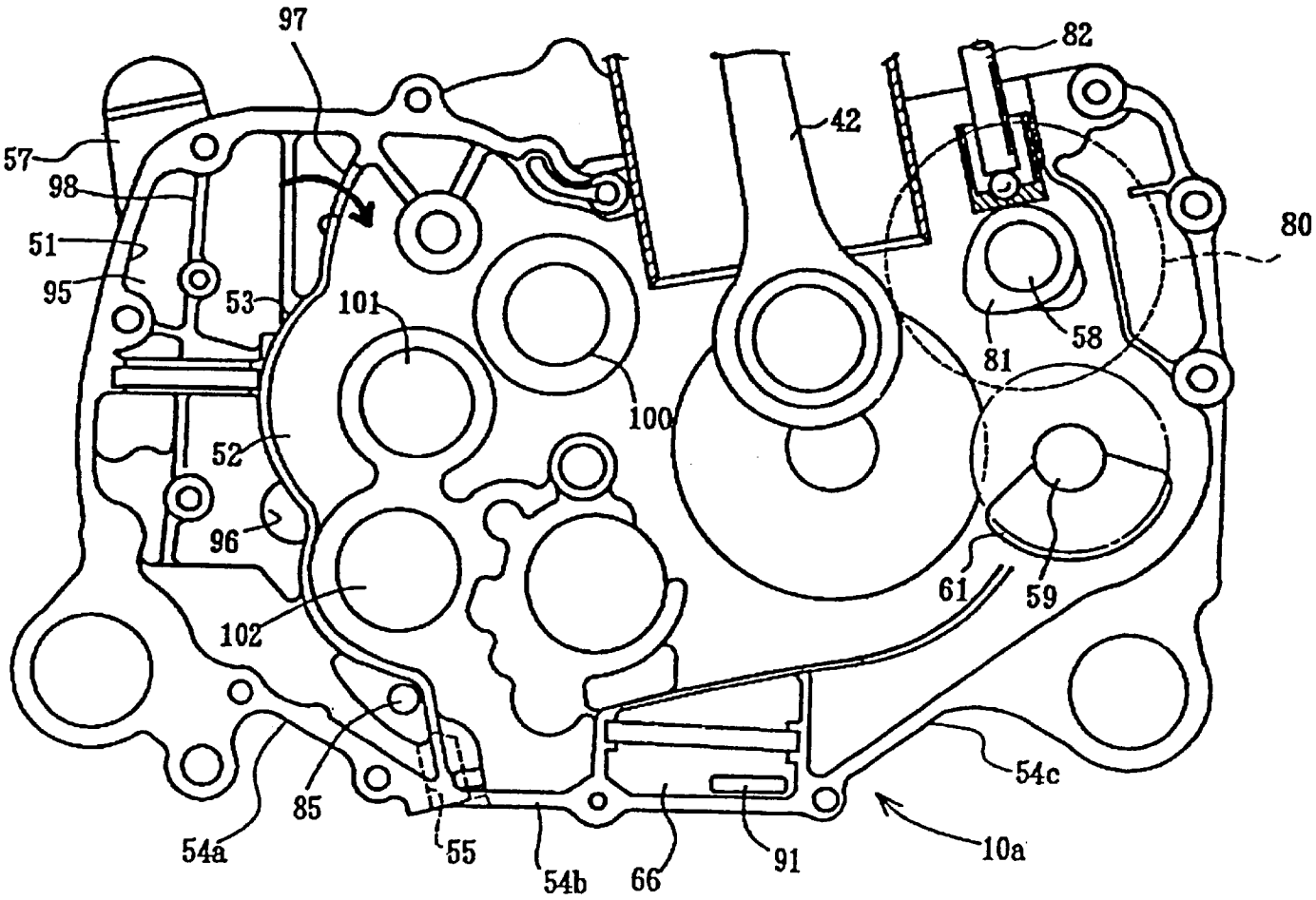
FIG. 9 is a rear view of the front case illustrating a joining surface of the front case for mating to a rear case.

FIG. 6 shows the front case cover 11 from the front. FIG. 7 shows the front case 10*a* from the front with part of the front case cover 11 cut away. FIG. 8 shows a front cover attaching surface of the front case 10*a* with the starting clutch 40 removed. FIG. 9 shows a surface of the front case 10*a,* to which the rear case 10*b* would be attached.

In FIGS. 6–9, the bottom section 54 of the front case 10*a* has a shape becoming narrower towards the bottom. The feed pump 63 of the oil pump 62 draws up oil from an inlet 85 (FIG. 9) provided at a lower end of the oil tank 51 via the feed pump pipe 72. The inlet 85 is formed at a lower end of the oil tank 51 wrapping around to the bottom of the output shaft 6 (FIG. 8). The feed pump pipe 72 runs over the starting clutch 40 and leads to a rear side of the starting clutch 40, and is piped to below the crankshaft 5 and the centrifugal clutch 47.

The feed pump 63 discharges oil from a discharge passageway 86 (FIG. 8) to the oil filter 65 (FIG. 7). The discharge outlet 87 of the oil filter 65 communicates with an oilway 88 facing towards the center of the crankshaft 5 formed in the front case cover 11. A filter housing 84 is provided in an upper shoulder of the front case cover 11. The oilway 88 is connected at the same time to an oilway 89 formed running through the center of the crankshaft 5 and to an oilway 90 formed running upwards above the front case cover 11. The oilway 90 supplies oil to parts other than the crankshaft 5, such as a valve mechanism and the transmission 44.

The scavenge pump 64 draws up oil from an inlet 91 through a scavenge pump pipe 92, using an oil sump 66 provided in the center section 54*b*. The scavenge pump pipe 92 runs diagonally along the direction of the sloping surface 54*c,* and has a middle section which is fastened to the front case 10*a* by a clip 93.

As shown in FIG. 6, an oil outlet 76 from the scavenge pump 64 is provided at a central section in the vertical direction of a front left end of the front case cover 11, at a position overlapping the oil pump 62. A return port 94, in communication with the return side hose 22 (FIG. 2) from the oil cooler 20, is provided in the right upper section of the front case, at a position overlapping the oil tank 51. Oil, returned from the oil cooler 20, enters the return port 94 and passes into sections of the oil tank 51 between the front case cover 11 and the front case 10*a*.

As shown in FIG. 7, a dividing or partition wall 95 is provided in the oil tank 51 for partitioning the inside of the oil tank 51 into a portion on the front case 10*a* side and a portion on the rear case 10*b* side. The partition wall 95 is provided with a rib 95*a,* and a communicating hole 96 communicated to the rear case 10*b* side. The communicating hole 96 is provided in the lower portion of the partition wall 95 at a position slightly elevated relative to the output shaft 6.

Oil entering between the front case cover 11 and the front case 10*a* flows through the communicating hole 96 to the oil tank 51 formed between the front case 10*a* and the rear case 10*b*. During the flow of oil to the oil tank 51, gas-liquid separation for the oil is promoted.

As shown in FIG. 9, a slot 97 is provided in an upper part of the bulkhead 53, and communication is established between the oil tank 51 and the transmission chamber 52. The height of the slot 97 is substantially the same as the height of the oil inlet 57. The slot 97 acts as an overflow to the inside of the transmission chamber, if supply to the oil tank 51 fills up. A number of ribs 98 are formed in the surface of the partition wall 95 on the rear case 10*b* side. FIG. 9 also illustrates a bearing hole 100 for the main shaft, a bearing hole 101 for the counter shaft, and a bearing hole 102 for the output shaft.

Figure 10:
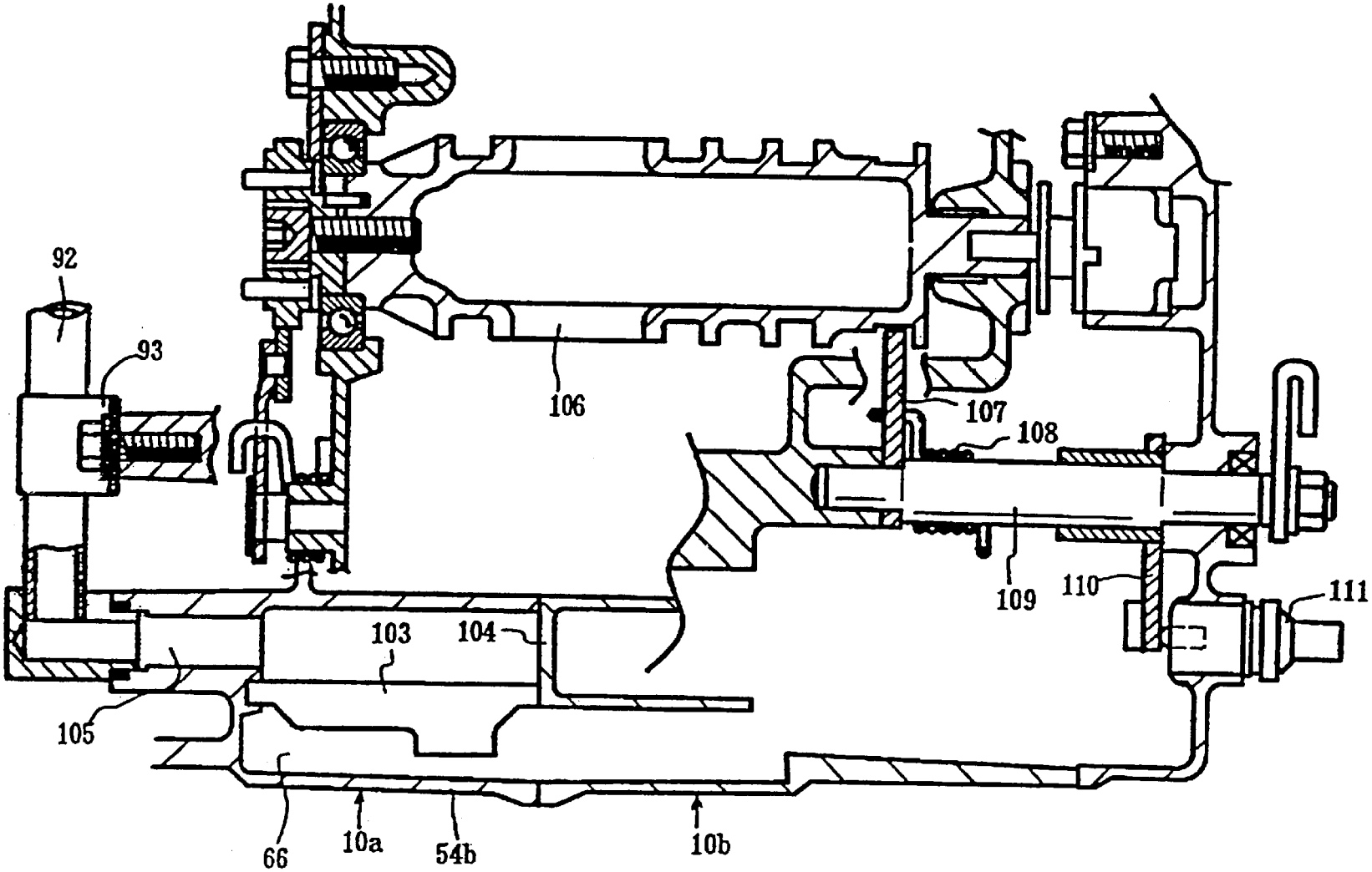
FIG. 10 is a cross sectional view taken in a longitudinal direction of the crankcase illustrating an oil sump pump of the oil pump.

FIG. 10 illustrates the structure of the oil sump 66. The oil sump 66 is formed in a section located at the juncture of the front case 10*a* and the central section 54*b* of the rear case 10*b*. A strainer 103 is contained in this space, with a rear portion of the strainer 103 supported by a wall section 104 of the rear case 10*b*. A scavenge pump inlet passageway 105 communicates with the oil sump 66 in the front case 10*a*. A lower end of the scavenge pump pipe 92 is connected to a tip opening section of the inlet passageway 105. FIG. 10 also illustrates a shift drum 106, a stopper arm 107, a return spring 108, a reverse switching shaft 109, a stopper sensor arm 110, and a stopper position detection switch 111.

Next, operation of the present invention will be described. Oil, after lubrication, drops down to the bottom 54 of the crankcase 10. Since the left and right of the crankcase 10 becomes narrower toward the bottom section 54, the oil easily accumulates in the oil sump 66 of the central section 54*b,* which is the lowest part of the crankcase 10. Oil accumulating in the oil sump 66 is drawn into the scavenge pump 64 housed inside the oil pump 62 via the scavenge pump pipe 92. This oil is sent through a discharge outlet 74, through a discharge outlet 75, formed in the front case cover 11, and through an outlet 76 to the sending side hose 21. The sending side hose 21 sends the oil to the oil cooler 20. Oil that has been cooled in the oil cooler 20 is returned to an upper section of the oil tank 51, via the return side hose 22 and the return outlet 94.

In this way, since the oil pump 62 and the oil tank 51 are provided on the left and right sides of the crankcase 10, the outlet 76 and the return port 94 can be provided in the left and right surfaces of the upper portion of the front case cover 11 covering the front case 10*a*. Accordingly, the outlet 76 and the return port 94 can be separately connected nearly in straight lines to the inlet and outlet provided in the left and right surfaces of the oil cooler 20 using the feed side hose 21 and the return side hose 22. As a result, the feed side hose 21 and the return side hose 22 can be made relatively short, and the piping layout can be simplified. This results in a reduction both in weight and cost, and also simplifies the assembly and maintenance procedures.

Furthermore, since the oil tank 51 and the oil pump 62 are arranged on the left and right sides of the crankshaft 5, the left side (the side on which the oil tank 51 is provided) of the oil cooler 20 facing to the front case cover 11 may be taken as the outlet and connected to the return side hose 22. The right side (the side on which the oil pump 62 is provided) of the oil cooler 20 may be taken as the inlet and connected to the feed side hose 21. With this arrangement, the feed side hose 21 and the return side hose 22 can be separated from each other and can be laid out in nearly straight lines. As a result, feed side hose 21 and the return side hose 22 can be made relatively short and the piping layout is simplified.

Since the oil tank 51 is elongated in the vertical direction and has a substantially crescent shape, and also since the crankcase 10 becomes narrower towards the bottom, oil is efficiently sent in to the inlet 85 at the lowest point, the capacity of the oil tank 51 can be made as large as a half or more of the total capacity of the crankcase 10, and the variation of the oil level is thus reduced. Since the oil tank 51 is provided in the crank case 10, the center of gravity is lowered and the weight of the parts is more concentrated, so that a change in the center of gravity due to variations in the oil level is reduced.

According to the present invention, the oil recovery rate or ratio is high and there is no need to use a special oil pump because the scavenge pump 64 draws up oil from the oil sump 66, which is located in the lowest part of the crankcase 10 wherein the crankcase becomes narrower towards the bottom. As a result, no special oil pan is required. Thus, ground clearance is increased, the overall height of the engine is reduced, and the oil passageways are shortened. Shortening the oil passageways shortens the time required to supply oil to portions of the engine to the lubricated.

According to the present invention, oil is returned from the oil cooler 20 to the return inlet 94 of the front case cover 11 provided on an upper part of the oil tank 51. The oil exiting from the return inlet 94 collides with the partition wall 95 of the oil tank 51. The oil then drops down downwardly and comes into contact with a number of the plurality of ribs 95*a*. This path of the oil exiting from the return inlet 94 causes air entrapped in the oil to be easily separated from the oil, thus facilitating gas-liquid separation of air within the oil. Moreover, movement of the oil through the communication hole 96 inside the oil tank 51 also promotes gas-liquid separation.

The plurality of ribs 95*a* and 98 not only serve to promote air-oil separation, the ribs 95*a* and 98 also act as structural reinforcement members. By reinforcing the walls of the oil tank 51, resonance due to vibration of the walls of the oil tank 51 is reduced or prevented.

Due to the slot 97, provided on an upper part of the bulkhead 53, excess oil in the oil tank 51 overflows from the slot 97 to the transmission chamber 52. If the width of the slot 97 is set so that the slot 97 covers the overall width of the gear train, the meshing sections and sliding sections of the gear train immediately below the slot 97, as well as sliding grooves of a shift drum, are lubricated. Because the oil tank 51 is usually filled, the feed pump 63 stably supplies oil to necessary lubrication locations.

The oil inlet 57 is provided just above the oil tank 51. When oil is added, excess oil overflows into the transmission chamber 52 through the cutout 97. As a result, it is easy to maintain an oil level inside the oil tank 51 at a specified level at all times. The present invention does not have an independent oil tank. However, by providing the overflow slot 97, it is possible to ensure the oil level using the same procedure as in a normal wet sump structure.

Since the bottom 54 and the bulkhead 53 are punched out so that the drain hole 55 communicates with both the oil tank 51 and the transmission chamber 52, a single drain hole 55 can be commonly used. Therefore, the number of manufacturing steps is minimized and only a single drain bolt 56 is used, thus reducing the number of parts. When the oil is changed, used oil is taken out from the drain hole 55 and new oil is put in through the inlet 57. The oil level is checked and confirmed using a level gauge.

Still further, a cam sprocket 80 of the cam shaft 58 and the oil pump 62 are respectively separately arranged behind and in front of the balance shaft 59. As a result, there is no danger of the oil pump 62 interfering with a cam chain 60 for driving the cam sprocket 80. Therefore, it is possible to increase the size of the oil pump 62 without increasing the size of the crankcase 10.

Further, oil pipe clips are arranged inside the starting clutch 40, and the cam chain 60 is arranged between a balancer gear 78 and the ACG 41, which means that a space for housing the oil tank 51 can be maintained more to the outside than these internal components. In this way, it is possible to design a more compact engine by more efficient use of space and to have more flexibility in arranging auxiliary devices and in planning the engine structure. Further, since there is no need to provide an independent oil tank, the advantages of a conventional dry sump structure are maintained, while also enjoying the advantages of simplifying the lubrication system.

The above described arrangement structure of the oil tank, transmission and auxiliary devices can also be used in engines other than engines for use with an ATV, and with engines which do not have an output shaft. When no output shaft is employed, the space of the output shaft may be assigned to the oil tank. As a result, an overall height of the right side may be reduced lower than the crank shaft, and it is possible to further slope the cylinder block to the right side using that empty space. As a result, it is possible to provide an engine having a low center of gravity with a reduced overall height. Also, it is possible to vertically divide connecting sections of the piping for the oil pump 62 and the oil tank 51, so that the scavenge pump 64 and the upper part of the oil tank 51 are connected, and the feed pump 63 and the lower part of the oil tank 51 are connected.

By the present invention, the camshaft and supplementary devices (such as the balancer and balancer shaft) for operating the valve mechanism, as well as the lubrication system are arranged close to one another and to one of either the left or right sides of the crankshaft. Further, the transmission is arranged on the other side of the crankshaft. The cam shaft and the oil pump are driven in parallel and the balancer shaft and the oil pump are driven coaxially. The oil pump and a driven section of the camshaft, such as a cam sprocket, are arranged on respectively opposite sides of the balancer. Therefore, it is possible to have an arrangement where the oil pump does not interfere with a drive member of the camshaft. As a result, it is possible achieve the benefits of a dry sump structure with an increased size oil pump, without the need to enlarge the size of a crank case. In other words, it is possible to make the internal combustion engine more compact relative to the background art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An internal combustion engine comprising:

a crankcase;

an oil tank inside said crankcase;

an oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank;

a crankshaft disposed in said crankcase; and a camshaft having a driven section attached thereto to be driven to rotate by rotation of said crankshaft, wherein said camshaft and said oil pump are arranged on one of a left side or a right side of said crankshaft and a transmission is arranged on the other of said left side or said right side of said crankshaft.

2. The engine according to claim 1, further comprising:

a balancer shaft having a balancer weight thereon, with said balancer shaft being parallel to said camshaft, wherein said balancer shaft is also located on said one side of said left side or said right side of said crankshaft.

3. The engine according to claim 2, wherein said driven section of said camshaft and said oil pump are respectively arranged on opposite sides of said balancer of said balancer shaft.

4. The engine according to claim 2, wherein said oil pump is coaxially driven by said balancer shaft.

5. The engine according to claim 2, wherein said oil pump includes a feed pump and scavenge pump which are driven coaxially.

6. The engine according to claim 5, wherein said oil pump is coaxially driven by said balancer shaft.

7. The engine according to claim 1, wherein said driven section of said camshaft is a cam sprocket and further comprising:

a crank sprocket attached to said crankshaft; and a cam chain engaged to said cam sprocket and said crank sprocket.

8. The engine according to claim 1, wherein said transmission includes a main shaft, a counter shaft and an output shaft arranged on said other of said left side or said right side of said crankshaft.

9. A combination comprising:

a vehicle; and an internal combustion engine including:

a crankcase;

an oil tank inside said crankcase;

an oil pump including a feed pump and a scavenge pump, said feed pump for supplying lubricating oil inside said oil tank to respective components of the internal combustion engine, and said scavenge pump for returning lubricating oil that has accumulated in a bottom of said crankcase to said oil tank;

a crankshaft disposed in said crankcase;

a camshaft having a driven section attached thereto to be driven to rotate by rotation of said crankshaft; and a balancer shaft having a balancer thereon, with said balancer shaft being parallel to said camshaft, wherein said camshaft, said balancer shaft, and said oil pump are arranged on one of a left side or a right side of said crankshaft and a transmission is arranged on the other of said left side or said right side of said crankshaft, and wherein said driven section of said camshaft and said oil pump are respectively arranged on opposite sides of said balancer of said balancer shaft.

10. The combination according to claim 9, wherein said oil pump includes a feed pump and a scavenge pump which are driven coaxially.

11. The combination according to claim 10, wherein said oil pump is coaxially driven by said balancer shaft.

12. The combination according to claim 9, wherein said driven section of said camshaft is a cam sprocket and further comprising:

a crank sprocket attached to said crankshaft; and a cam chain engaged to said cam sprocket and said crank sprocket.

13. The combination according to claim 9, wherein said transmission includes a main shaft, a counter shaft and an output shaft arranged on said other of said left side or said right side of said crankshaft.

14. The combination according to claim 9, wherein said vehicle is an ATV.

* * * * *